US010980353B2

(12) United States Patent
Clousing et al.

(10) Patent No.: US 10,980,353 B2
(45) Date of Patent: Apr. 20, 2021

(54) TWO-IN-ONE MATTRESS WITH AIR MATTRESS AND MEMORY FOAM FOR PATIENT CARE

(71) Applicant: MedicusTek, Inc., Taipei (TW)

(72) Inventors: Aaron R. Clousing, Costa Mesa, CA (US); Chia-Ming Hsu, Taipei (TW); Tsai-Yu Lin, Taipei (TW)

(73) Assignee: MEDICUSTEK, INC., Taipei (TW)

( * ) Notice: Subject to any disclaimer, the term of this patent is extended or adjusted under 35 U.S.C. 154(b) by 210 days.

(21) Appl. No.: 15/788,487

(22) Filed: Oct. 19, 2017

(65) Prior Publication Data

US 2019/0116987 A1 Apr. 25, 2019

(51) Int. Cl.

| | |
|---|---|
| ***A47C 27/10*** | (2006.01) |
| ***A47C 27/08*** | (2006.01) |
| ***A61G 7/057*** | (2006.01) |
| ***A47C 27/18*** | (2006.01) |
| ***A47C 27/15*** | (2006.01) |
| ***A61G 7/05*** | (2006.01) |

(52) U.S. Cl.

CPC ..... *A47C 27/10* (2013.01); *A47C 27/083* (2013.01); *A47C 27/15* (2013.01); *A47C 27/18* (2013.01); *A61G 7/05769* (2013.01); *A61G 7/05776* (2013.01); *A61G 7/0525* (2013.01); *A61G 2203/34* (2013.01)

(58) Field of Classification Search

CPC ... A47C 27/081; A47C 27/083; A47C 27/088; A47C 27/10; A47C 27/15; A47C 27/18; A61G 7/0525; A61G 7/05753; A61G 7/05769; A61G 7/05776; A61G 2203/34; F16B 12/58; F16B 12/56

See application file for complete search history.

(56) References Cited

U.S. PATENT DOCUMENTS

| | | | | |
|---|---|---|---|---|
| 5,325,551 | A * | 7/1994 | Tappel | A47C 27/082 5/709 |
| 8,006,333 | B2 * | 8/2011 | Genaro | A61G 7/05776 5/615 |
| 2005/0172405 | A1 | 8/2005 | Menkedick et al. | |
| 2006/0085919 | A1 | 4/2006 | Kramer et al. | |
| 2007/0101504 | A1 * | 5/2007 | Gilchrest, Jr. | A61G 7/0504 5/706 |

(Continued)

OTHER PUBLICATIONS

International Search Report issued in corresponding International Application No. PCT/US2018/056453 dated Dec. 21, 2018 (2 pages).

(Continued)

*Primary Examiner* — Robert G Santos
*Assistant Examiner* — Alison N Labarge
(74) *Attorney, Agent, or Firm* — Osha Bergman Watanabe & Burton

(57) ABSTRACT

A mattress, bed, cushion, or other device to support a user in a pre-determined posture. The mattress, bed, cushion, or other device includes compressible cells configured to inflate based on characteristics of particular contact areas of the user, and contact, in response to inflating based on the characteristics, the user in various contact areas to support the pre-determined posture. In particular, inflating the compressible cells based on characteristics of particular contact areas reduces the risk of the user developing pressure ulcers.

17 Claims, 4 Drawing Sheets

(56) References Cited

U.S. PATENT DOCUMENTS

| | | | | |
|---|---|---|---|---|
| 2008/0005843 | A1* | 1/2008 | Lokhorst | A47C 27/082 5/655.3 |
| 2010/0064443 | A1* | 3/2010 | Lee | A61G 7/05776 5/713 |
| 2011/0213503 | A1* | 9/2011 | Porter, III | A61G 5/1043 700/282 |
| 2011/0218684 | A1* | 9/2011 | Genaro | A47C 27/10 700/282 |
| 2014/0345060 | A1 | 11/2014 | Ribble et al. | |
| 2015/0000044 | A1* | 1/2015 | Morimura | A47C 27/083 5/710 |
| 2017/0035636 | A1* | 2/2017 | Stiff | A61G 7/05776 |
| 2018/0263378 | A1* | 9/2018 | Anastasov | A47C 31/00 |

OTHER PUBLICATIONS

Written Opinion issued in corresponding International Application No. PCT/US2018/056453 dated Dec. 21, 2018 (8 pages).
Notice of Allowance with English translation issued in corresponding TW Application No. 107137124 dated Oct. 25, 2019 (4 pages).

* cited by examiner

TWO-IN-ONE MATTRESS WITH AIR MATTRESS AND MEMORY FOAM FOR PATIENT CARE

BACKGROUND

Pressure ulcers (e.g., pressure sores, bedsores, or decubitus ulcers) often occur on skin overlying sacrum, coccyx, heels, hips, elbows, knees, back of shoulders, back of the cranium, etc. Pressure ulcers are localized damage to the skin and/or underlying tissue caused by pressure, or pressure in combination with shear and/or friction. Pressure ulcers may develop in individuals who are bedridden or confined to a wheelchair.

SUMMARY

In general, in one aspect, the invention relates to a mattress to support a user in a pre-determined posture. The mattress includes a first compressible cell configured to inflate based on a first characteristic of a first contact area of the user, and contact, in response to inflating based on the first characteristic, the user in the first contact area, and a second compressible cell configured to inflate based on a second characteristic of a second contact area of the user, and contact, in response to inflating based on the second characteristic, the user in the second contact area.

In general, in one aspect, the invention relates to a bed for patient care to support a user in a pre-determined posture. The bed includes a first compressible cell configured to inflate based on a first characteristic of a first contact area of the user, and contact, in response to inflating based on the first characteristic, the user in the first contact area, a second compressible cell configured to inflate based on a second characteristic of a second contact area of the user, and contact, in response to inflating based on the second characteristic, the user in the second contact area, and a memory foam portion configured to support the first compressible cell and the second compressible cell against the user in the pre-determined posture.

In general, in one aspect, the invention relates to a cushion for patient care to support a user in a pre-determined posture. The cushion includes a first compressible cell configured to inflate based on a first characteristic of a first contact area of the user, and contact, in response to inflating based on the first characteristic, the user in the first contact area, and a second compressible cell configured to inflate based on a second characteristic of a second contact area of the user, and contact, in response to inflating based on the second characteristic, the user in the second contact area.

Other aspects and advantages of the invention will be apparent from the following description and the appended claims.

DETAILED DESCRIPTION

Figure 1:
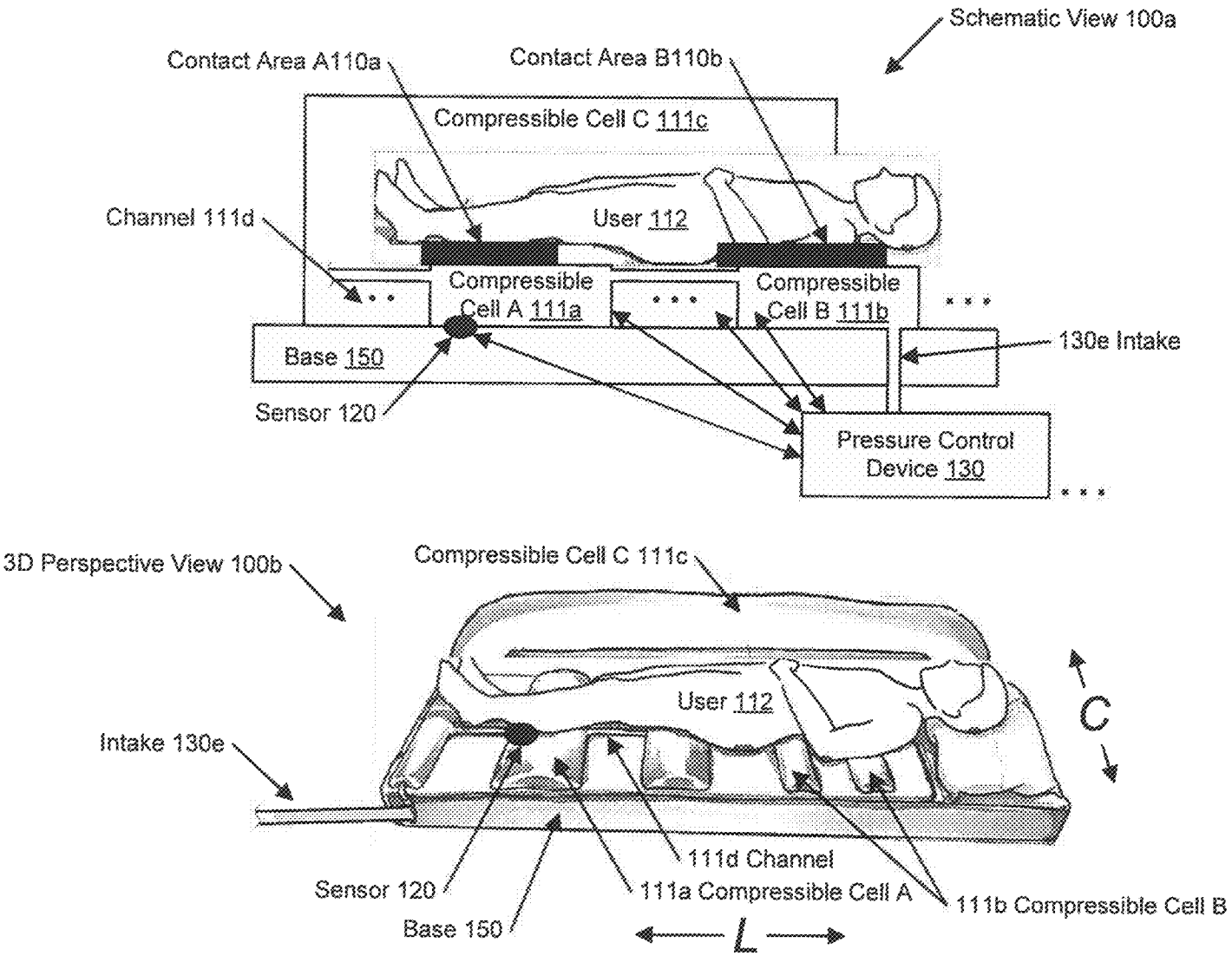
FIG. 1 shows a schematic diagram and a perspective view diagram according to one or more embodiments of the invention.

Specific embodiments will now be described in detail with reference to the accompanying figures. Like elements in the various figures are denoted by like reference numerals for consistency. Like elements may not be labeled in all figures for the sake of simplicity.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements nor limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a horizontal beam" includes reference to one or more of such beams.

Terms like "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Although multiple dependent claims are not introduced, it would be apparent to one of ordinary skill in that that the subject matter of the dependent claims of one or more embodiments may be combined with other dependent claims. For example, even though claim 3 does not directly depend from claim 2, even if claim 2 were incorporated into independent claim 1, claim 3 is still able to be combined with independent claim 1 that would now recite the subject matter of dependent claim 2.

In general, embodiments of the invention relate to a user posture support device to support a user's weight in one or more postures. In one or more embodiments, the device is a mattress, a bed, or a cushion that includes compressible cells. The mattress, bed, or cushion may be of suitable overall size and shape based on the area/space/volume occupied by the user in the one or more postures.

FIG. 1 shows a schematic diagram and a perspective view diagram of a user posture support device according to one or more embodiments of the invention. In one or more embodiments, one or more of the modules and elements shown in FIG. 1 may be omitted, repeated, and/or substituted. Accordingly, embodiments of a sensor pad for monitoring user posture should not be considered limited to the specific arrangements of modules shown in FIG. 1.

Specifically, FIG. 1 shows a schematic view (100*a*) and an example 3-dimensional (3D) perspective view (100*b*) of the user posture support device used by a user (112). In particular, in the 3D perspective view (100*b*), the longitudinal direction of the user (112) is denoted as "L" while the sideways direction of the user (112) is denoted as "C". In one or more embodiments of the invention, the user posture support device depicted in FIG. 1 may be a mattress, a cushion, a bed, a wheel chair, or other device for supporting the user (112) in a pre-determined posture, such as lying, sitting, standing, leaning, etc. postures. The user posture support device includes multiple compressible cells (e.g., compressible cell A (111*a*), compressible cell B (111*b*), compressible cell C (111*c*)) disposed on a base (150) and coupled to a pressure control device (130). The based (150) is a structural element that supports the multiple compressible cells (e.g., compressible cell A (111*a*), compressible cell B (111*b*), compressible cell C (111*c*)) against the user (112) in the pre-determined posture. For example, the base (150) may be constructed using memory foam of a particular density. As used herein, memory foam refers to viscoelastic polyurethane foam or low-resilience polyurethane foam (LRPu) that softens in reaction to body heat and conforms to a body contour within a few minutes.

In one or more embodiments of the invention, the user (112) is a patient, such as a human patient or an animal patient. In one or more embodiments, the compressible cell is a flexible enclosure configured to contain a volume of compressible fluid, such as air, a mixture/combination of air or other gas with liquid (e.g., water), a jell that contains air or other gas pocket(s)/bubble(s), etc. For example, the flexible enclosure may be constructed using flexible material, such as rubber, vinyl, thermoplastic polyurethane (TPU), polyvinyl chloride (PVC), latex, textile reinforced urethane, and have any shape or size. In particular, the flexible enclosure may be constructed using a film of such flexible material.

In one or more embodiments, the compressible cells (e.g., compressible cell A (111*a*), compressible cell B (111*b*), compressible cell C (111*c*)) are inflated and/or deflated via an intake (130*e*) (e.g., a valve, hose, tube, pipe, etc.) to maintain and/or adjust a fluid pressure. For example, the compressible cells may include an air cell that is inflated and/or deflated using air to maintain and/or adjust an air pressure. In one or more embodiments, one or more of the compressible cells (e.g., compressible cell A (111*a*)) are inflated and/or deflated by a pressure control device (130). In one or more embodiments, one or more of the compressible cells (e.g., compressible cell B (111*b*)) are inflated and/or deflated by the pressure control device (130) via intervening compressible cells (e.g., compressible cell A (111*a*)) and connecting fluid channels (e.g., channel (111*d*)). The fluid channel is a fluid passage connecting two or more compressible cells. In one or more embodiments, the fluid channel has a substantially smaller (e.g., by a factor of 4 or more) cross-sectional area than the connected compression cells such that the connected compression cells maintain respective shapes/sizes substantially independent of each other. In one or more embodiments, all compression cells (e.g., compressible cell A (111*a*), compressible cell B (111*b*), compressible cell C (111*c*)) are connected together using intervening fluid channels and receive fluids from a single pressure control device (i.e., pressure control device (130)). In one or more embodiments, the compression cells (e.g., compressible cell A (111*a*), compressible cell B (111*b*), compressible cell C (111*c*)) are divided into multiple compression cell groups. The compression cell group is a group of compression cells that are connected together using intervening fluid channels and receive fluids from a single pressure control device (e.g., pressure control device (130)). In other words, the user posture support device depicted in FIG. 1 may include multiple pressure control devices (e.g., pressure control device (130)) each used to inflate and/or deflate one compression cell group.

In one or more embodiments, the pressure control device (130) may include an air pump. The fluid pressure (e.g., air pressure) may be maintained and/or adjusted statically to remain a constant level, or maintained/adjusted dynamically to have varying levels with respect to time. In one or more embodiments, the enclosure of the air cell includes one or more pin holes such that the air pressure is maintained and/or adjusted with air constantly flowing in from the intake then exiting through the pin hole(s). This air flow may affect temperature and humidity in the vicinity of the user (112). In particular, the air flow may alter the microclimate near the user's skin in a manner that reduces the risk of pressure ulcers.

In one or more embodiments, by way of the pressure control device (130), the compressible cell (e.g., compressible cell A (111*a*), compressible cell B (111*b*)) is configured to inflate based at least on a characteristic of a contact area (e.g., contact area A (110*a*), contact area B (110*b*)) of the user (112). In response to inflating, the compressible cell A (111*a*) and compressible cell B (111*b*) contacts the user (112) in the contact area A (110*a*) (e.g., lower leg area) and contact area B (110*b*) (e.g., shoulder blade area), respectively. Once inflated, the compressible cell exhibits an inflated contour based on a pre-inflation contour and the characteristic of the contact area. As used herein, the inflated contour is an outline or other type of shape of the compressible cell subsequent to being inflated. In contrast, the pre-inflation contour is an outline or other type of shape of the compressible cell prior to being inflated. In one or more embodiments, the characteristic of the contact area includes a body contour area and/or a underlying body composition of the user (112) in the contact of the user (112). For example, the inflated contour of the compressible cell A (111*a*) substantially conforms to the body contour of the lower leg of the user (112) to the extent bounded by the pre-inflation contour of the compressible cell A (111*a*). Similarly, the inflated contour of the compressible cell B (111*b*) substantially conforms to the body contour of the shoulder of the user (112) to the extent bounded by the pre-inflation contour of the compressible cell B (111*b*).

At the contact area A (110*a*), the weight and compliableness (i.e., soft or hard) of the lower leg portion of the user (112), the fluid pressure and compliableness of the compressible cell A (111*a*), and a force (e.g., tension) in the flexible enclosure of the compressible cell A (111*a*) interact with each other to reach a balance of forces. Similarly, at the contact area B (110*b*), the weight and compliableness of the shoulder blade portion of the user (112), the fluid pressure and compliableness of the compressible cell B (111*b*), and the force (e.g., tension) in the flexible enclosure of the compressible cell B (111*b*) interact with each other to reach another balance of forces. Due to different body compositions of the user (112) at the lower leg (i.e., dominated by flesh) versus the shoulder blade (i.e., dominated by bone), the balance of forces at the contact area A (110*a*) differs from the balance of forces at the contact area B (110*b*) to result in different pressures applied to and received by the user (112) at the contact area A (110*a*) and the contact area B (110*b*). The pressure applied to and received by the user (112) at a particular contact area is referred to as the skin pressure at the contact area. To further enlarge the difference in skin pressures applied to and received by the user (112), the balance of forces at the contact area A (110*a*) may further differ from the balance of forces at the contact area B (110*b*)

due to different body contours of the lower leg versus shoulder blade, as well as different pre-inflation contours of the compressible cell A (111*a*) versus compressible cell B (111*b*).

In one or more embodiments, one or more pressure sensors are disposed on one or more compressible cells (e.g., the pressure sensor (120) on the compressible cell A (111*a*)). For example, the pressure sensor (e.g., the pressure sensor (120)) may be disposed at the interface between the compressible cell (e.g., compressible cell A (111*a*)) and the base (150). In another example, the pressure sensor (e.g., the pressure sensor (120)) may be disposed at the interface between the user (112) and the compressible cell (e.g., compressible cell A (111*a*)). In one or more embodiments, the pressure sensor (120) is configured to generate a pressure measurement representing the interface pressure exerted at the corresponding interface. In one or more embodiments, the pressure sensor (120) is further configured to send a signal (representing the pressure measurement) to the pressure control device (130) to facilitate adjusting the air pressure of the compressible cell A (111*a*) based at least on the pressure measurement. For example, the signal may be displayed by the pressure control device (130) to a healthcare professional. In another example, the signal may trigger an automatic action of the pressure control device (130). If the pressure measurement exceeds a pre-determined high threshold indicating skin ulcer risk, the pressure control device (130) releases, manually controlled or automatically triggered, certain amount of fluid (e.g., air) from the compressible cell A (111*a*), via intervening compressible cell(s) and fluid channel(s)), to reduce the interface pressure, and therefore reducing the corresponding skin pressure for mitigating the skin ulcer risk. In contrast, If the pressure measurement is less than a pre-determined low threshold indicating lack of body support, the pressure control device (130) injects, manually controlled or automatically triggered, certain amount of fluid (e.g., air) into the compressible cell A (111*a*), via intervening compressible cell(s) and fluid channel(s)), to increase the interface pressure for improving the support of the posture of the user (112).

In one or more embodiments, the compressible cell C (111*c*) has an inflated height that is higher than the compressible cell A (111*a*) and compressible cell B (111*b*). The air pressure of the compressible cell C (111*c*) serves to impede a lateral movement of the user (112) to prevent the user (112) from accidentally rolling or falling off the compressible cells and/or the base (150). Although the user (112) is shown in FIG. 1 as lying on the compressible cells (e.g., compressible cell A (111*a*), compressible cell B (111*b*), compressible cell C (111*c*)), the user (112) may also assume other postures (e.g., sitting, standing, leaning, etc.) with respect to the compressible cells.

Figure 2:
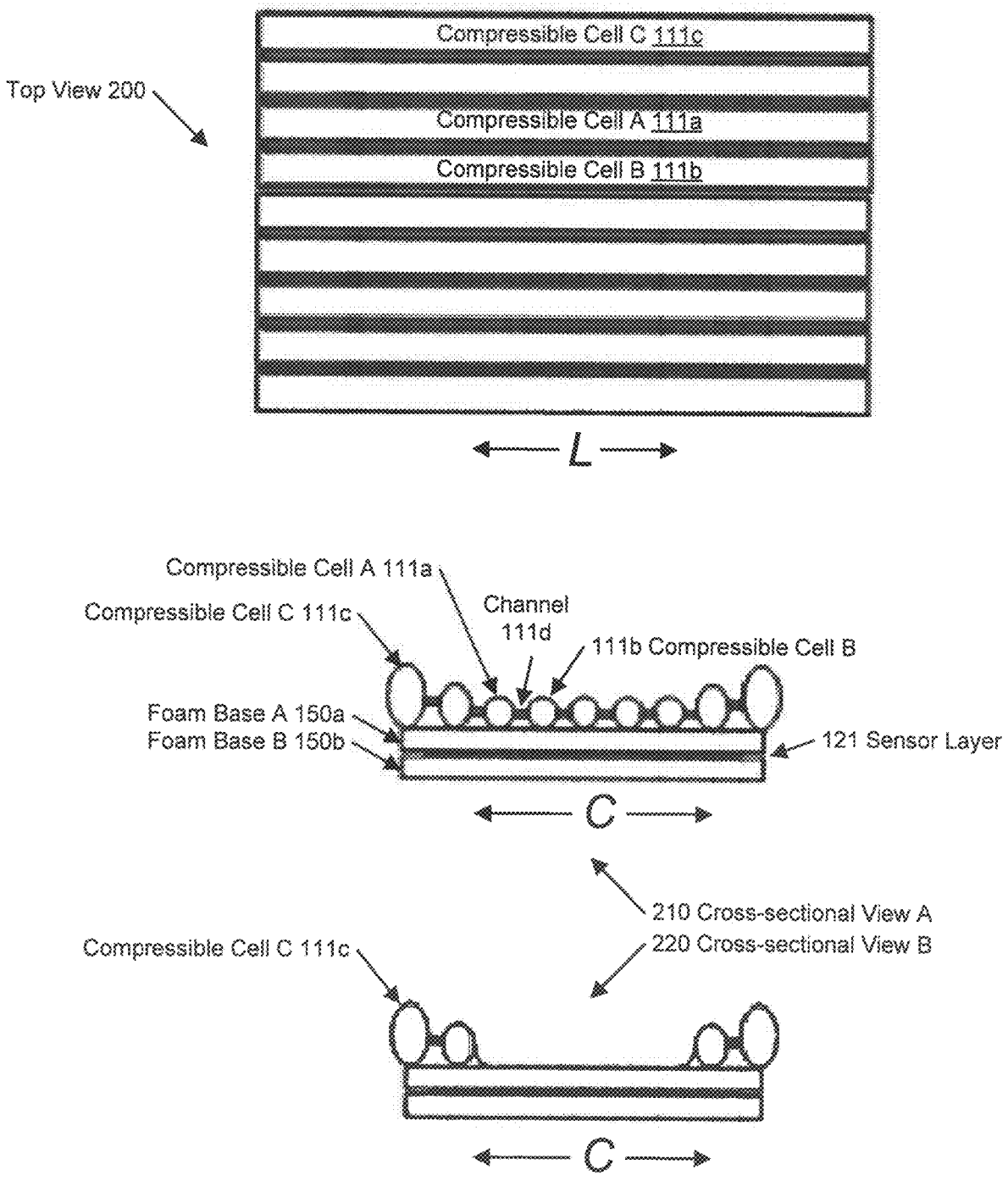
FIG. 2 shows a top view diagram and a cross-sectional view diagram according to one or more embodiments of the invention.

FIG. 2 shows a top view diagram and a cross-sectional view diagram according to one or more embodiments of the invention. In one or more embodiments, one or more of the modules and elements shown in FIG. 2 may be omitted, repeated, and/or substituted. Accordingly, embodiments of sensor pad for monitoring user posture should not be considered limited to the specific arrangements of modules shown in FIG. 2.

Specifically, FIG. 2 shows a top view (200) and corresponding cross-sectional view A (210) and cross-sectional view B (220) of an example user posture support device. The example user support device depicted in FIG. 2 has a different layout than the user support device depicted in the 3D perspective view (100*b*) depicted in FIG. 1 above. Specifically, the top view (200) shows compressible cells (e.g., compressible cell A (111*a*), compressible cell B (111*b*), compressible cell C (111*c*)) as parallel rectangles along the longitudinal direction "L" of a user (not shown) that, e.g., may correspond to the user (112) depicted in FIG. 1 above. Correspondingly, the cross-sectional view A (210) shows a cross-section of the parallel compressible cells depicted in the top view (200). Each of the parallel rectangular shaped compressible cells (e.g., compressible cell A (111*a*), compressible cell B (111*b*), compressible cell C (111*c*)) is depicted as an oval shaped cross-section along the sideways direction "C" in the cross-sectional view A (210). Adjacent parallel rectangular shaped compressible cells (e.g., compressible cell A (111*a*), compressible cell B (111*b*)) are connected via fluid channels (e.g., channel (111*d*)). The base (150) depicted in FIG. 1 above is shown as two layers (i.e., foam base A (150*a*) and foam based B (150*b*), e.g., constructed using memory foam) overlapping each other where the sensor layer (121) is disposed in-between the foam base A (150*a*) and the foam based B (150*b*). For example, the sensor layer (121) may include multiple pressure sensors, such as the sensor (120) depicted in FIG. 1 above.

The cross-sectional view B (220) shows a variation of the cross-sectional view A (210) where five parallel rectangular shaped compressible cells are omitted from the example depicted in the top view (200) and corresponding cross-sectional view A (210).

Figure 3:
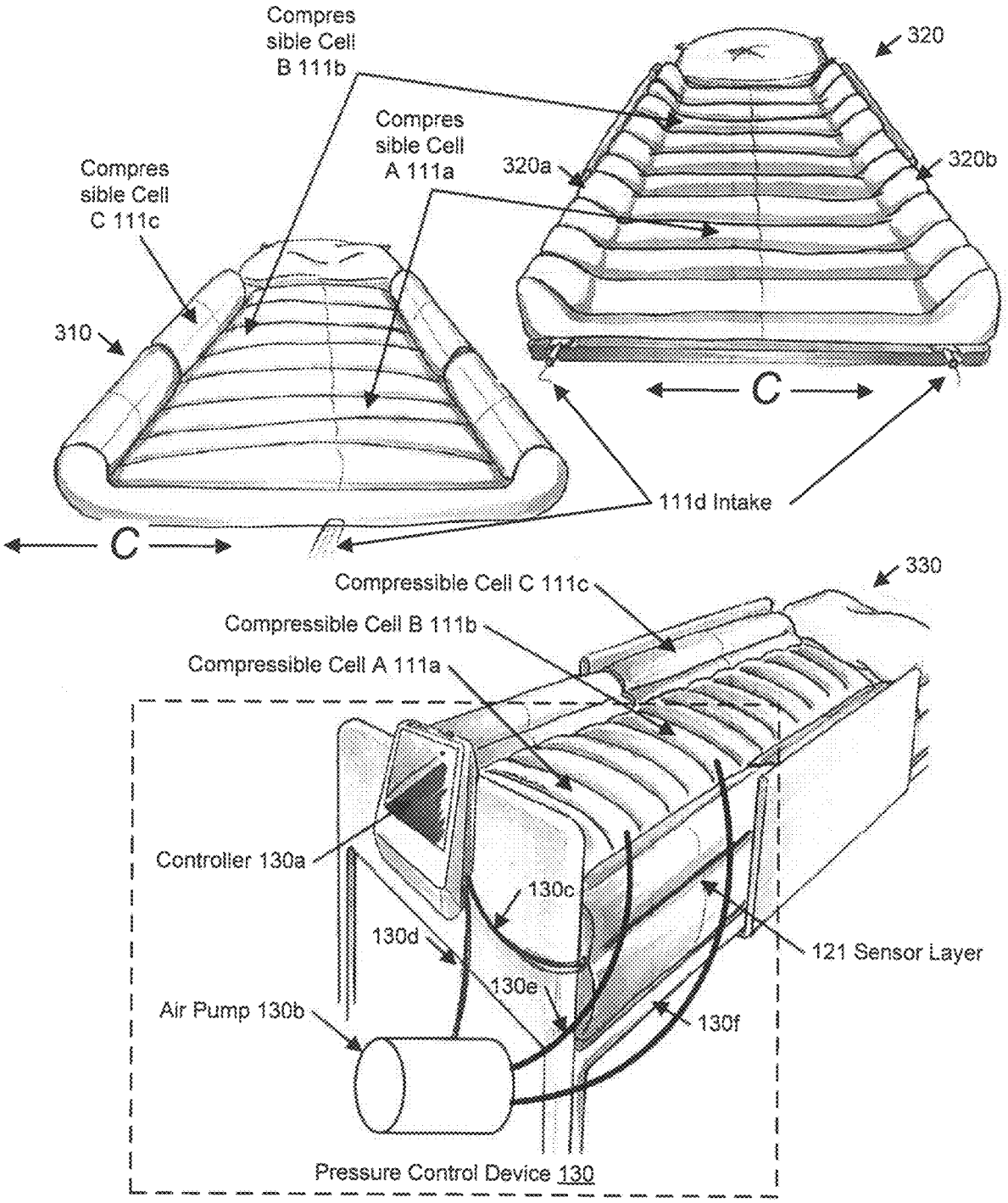
FIG. 3 shows layout and application examples according to one or more embodiments of the invention.

FIG. 3 shows examples of a user posture support device according to one or more embodiments of the invention. In one or more embodiments, one or more of the modules and elements shown in FIG. 3 may be omitted, repeated, and/or substituted. Accordingly, embodiments of sensor pad for monitoring user posture should not be considered limited to the specific arrangements of modules shown in FIG. 3.

Specifically, the example (310) shows inflated compressible cells (e.g., compressible cell A (111*a*), compressible cell B (111*b*)) that are parallel to each other along the sideways direction "C". Additional inflated compressible cells (e.g., compressible cell C (111*c*)) with elevated heights are added along the perimeter of the parallel compressible cells to prevent the user from accidentally rolling or falling off the user posture support device.

The example (320) shows a variation to the example (310) where each of the inflated compressible cells (e.g., compressible cell A (111*a*), compressible cell B (111*b*)) has raised ends (e.g., end A (320*a*), end B (320*b*)) to prevent the user from accidentally rolling or falling off the user posture support device.

The example (330) shows the user posture support device configured as a bed having a mattress depicted in the example (310). In particular, the bed includes a pressure control device (130) having a controller (130*a*) and an air pump (130*b*). The air pump (130*b*) is used to inflate and/or deflate the compressible cells (e.g., compressible cell A (111*a*), compressible cell B (111*b*), compressible cell C (111*c*)) via one or more intakes (e.g., intake (130*d*), intake (130*f*)). By having separate and independent intakes (e.g., intake (130*d*), intake (130*f*), the air pressures of the compressible cell A (111*a*) and compressible cell B (111*b*) are separately and independently adjustable using separate air outputs of the air pump (130*b*). This allows different body portions (e.g., lower leg, shoulder blades) of the user to experience different skin pressures.

The sensor layer (121) generates pressure measurements for sending via a signal cable (130*c*) to the controller (130*a*) that controls the air pump (130*b*) via a controlling cable (130*d*). According to the displayed pressure readings, reflecting the skin pressures applied to and received by different body portions (e.g., lower leg, shoulder blades) of the user, a healthcare professional may adjust the pressure outputs of the air pump (130*b*) to lower the air pressure of one or more of the compressible cell(s) to reduce corresponding skin pressure(s) and ulcer risk(s). In another example, the healthcare professional may adjust the pressure outputs of the air pump (130*b*) to raise the air pressure to improve support to the user's posture.

TABLE 1 shows example parameters of the compressible cells and associated components of the user posture support device depicted in FIGS. 1-3 above. The height range refers to the vertical dimension perpendicular to the aforementioned longitudinal direction "L" and the sideways direction "C". The width range refers to the shorter of the other two dimensions along either the longitudinal direction "L" or the sideways direction "C".

TABLE 1

| | Height Range | Width Range |
|---|---|---|
| Compressible Cell A or B | 0.4~20 cm | 9.5~40 cm |
| Compressible Cell C | 0~40 cm | 0~15 cm |
| Channel | N/A | 0~20 cm |
| Foam Base A | 0~20 cm | >30 cm |
| Foam Base B | 0~20 cm | >30 cm |

Figure 4:
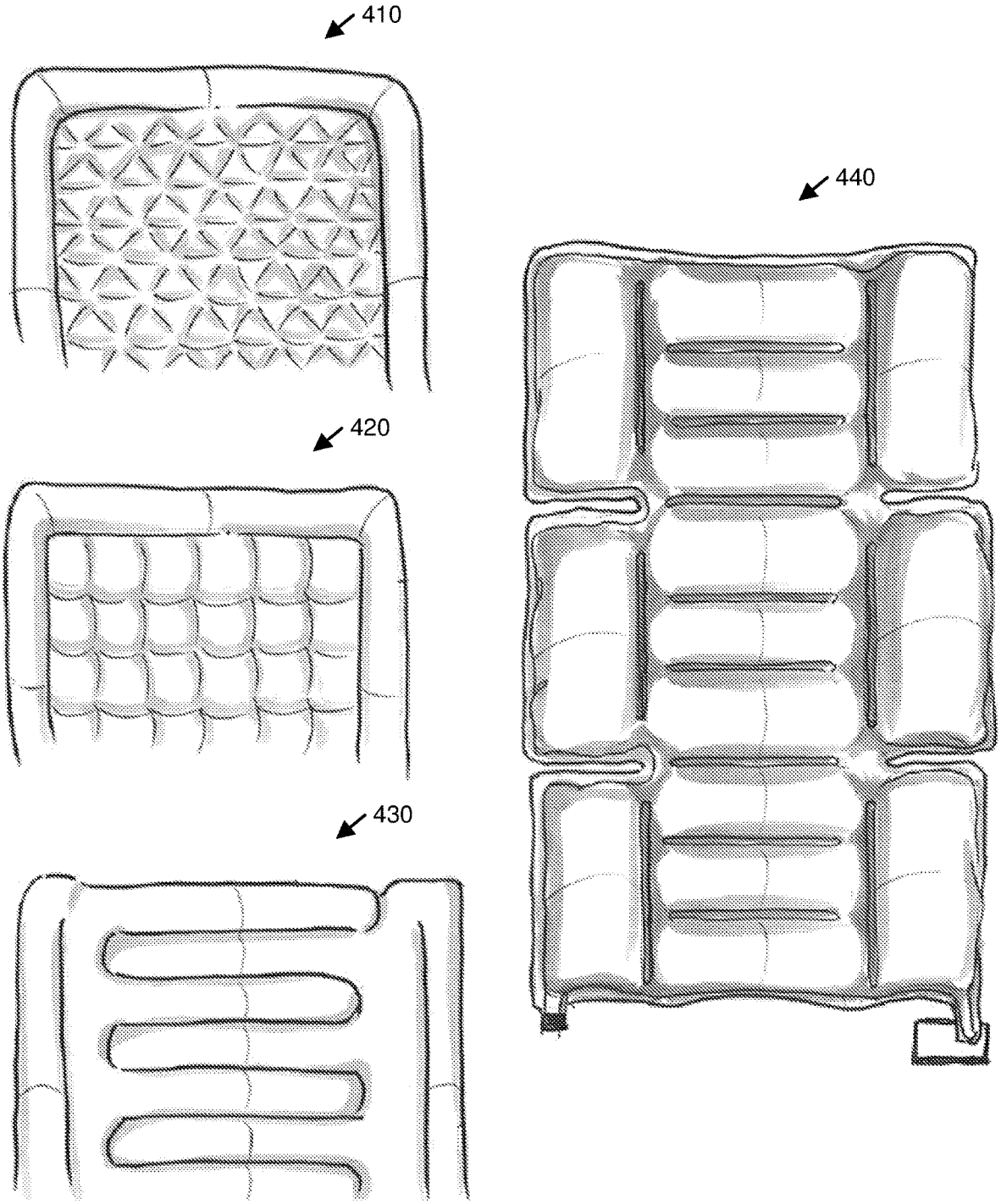
FIG. 4 shows additional examples according to more or more embodiments of the invention.

In addition to the various layout patterns for compressible cells shown and described in reference to FIGS. 1-3 above, FIG. 4 shows additional example layouts (410-440) of the compressible cells for the user posture support device. Although specific shapes of the compressible cells are shown in FIGS. 1-4, other shapes may also be used without deviating from the invention.

While one or more embodiments have been described with respect to a limited number of embodiments, those skilled in the art, having benefit of this disclosure, will appreciate that other embodiments may be devised which do not depart from the scope as disclosed herein. Accordingly, the scope should be limited only by the attached claims.

What is claimed is:

1. A mattress to support a user in a pre-determined posture, comprising:

a first compressible cell configured to:

inflate via a first air intake and based on a first characteristic of a first contact area of the user; and contact, in response to inflating based on the first characteristic, the user in the first contact area on a top side of the first compressible cell;

a second compressible cell configured to:

inflate via a second air intake and based on a second characteristic of a second contact area of the user; and contact, in response to inflating based on the second characteristic, the user in the second contact area;

a first memory foam portion comprising:

a upper side in contact with a bottom side of the first compressible cell that is separate from the user, and a lower side opposite the upper side;

a pressure control device configured to adjust air pressure of at least the first compressible cell;

a first pressure sensor configured to:

sense a first skin pressure in at least the first contact area; and send a first signal to the pressure control device to facilitate adjusting, via the first air intake, a first air pressure of at least the first compressible cell based at least on the first skin pressure; and a second pressure sensor configured to:

sense a second skin pressure in at least the second contact area; and send a second signal to the pressure control device to facilitate adjusting, via the second air intake, a second air pressure of at least the second compressible cell based at least on the second skin pressure, wherein the first air intake and the second air intake are separate and independent from each other, wherein the first air pressure and the second air pressure are adjusted separately and independently from each other to allow the first contact area and the second contact area of the user to experience different skin pressures, and wherein the first pressure sensor and the second pressure sensor are disposed on and in contact with the lower side of the first memory foam portion.

2. The mattress of claim 1, wherein the first compressible cell comprises a first inflated contour based at least on the first characteristic of the first contact area, and wherein the second compressible cell comprises a second inflated contour based at least on the second characteristic of the second contact area.

3. The mattress of claim 1, wherein the first characteristic comprises a first body contour of the user in the first contact area, and wherein the second characteristic comprises a second body contour of the user in the second contact area.

4. The mattress of claim 1, wherein the first characteristic comprises a first underlying body composition of the user in the first contact area, and wherein the second characteristic comprises a second underlying body composition of the user in the second contact area.

5. The mattress of claim 1, further comprising:

a second memory foam portion in cooperation with the first memory foam portion to support the first compressible cell and the second compressible cell against the user in the pre-determined posture, wherein the first pressure sensor is disposed between the first memory foam portion and the second memory foam portion.

6. The mattress of claim 1, further comprising:

a third compressible cell disposed external to a body boundary of the user in the pre-determined posture and configured to:

inflate to a pre-determined height that is higher than the first compressible cell when inflated and the second compressible cell when inflated; and prevent, in response to inflating to the pre-determined height, the user from rolling off the mattress.

7. A bed for patient care to support a user in a pre-determined posture, comprising:

a first compressible cell configured to:

inflate via a first air intake and based on a first characteristic of a first contact area of the user; and contact, in response to inflating based on the first characteristic, the user in the first contact area on a top side of the first compressible cell;

a second compressible cell configured to:

inflate via a second air intake and based on a second characteristic of a second contact area of the user; and contact, in response to inflating based on the second characteristic, the user in the second contact area;

a first memory foam portion comprising:
a upper side in contact with a bottom side of the first compressible cell that is separate from the user, and
a lower side opposite the upper side;
a pressure control device configured to adjust air pressure of at least the first compressible cell;
a first pressure sensor configured to:
sense a first skin pressure in at least the first contact area; and
send a first signal to the pressure control device to facilitate adjusting, via the first air intake, a first air pressure of at least the first compressible cell based at least on the first skin pressure;
a second pressure sensor configured to:
sense a second skin pressure in at least the second contact area; and
send a second signal to the pressure control device to facilitate adjusting, via the second air intake, a second air pressure of at least the second compressible cell based at least on the second skin pressure,
wherein the first air intake and the second air intake are separate and independent from each other,
wherein the first air pressure and the second air pressure are adjusted separately and independently from each other to allow the first contact area and the second contact area of the user to experience different skin pressures; and
a second memory foam portion in cooperation with the first memory foam portion to support the first compressible cell and the second compressible cell against the user in the pre-determined posture,
wherein the first pressure sensor and the second pressure sensor are disposed between the first memory foam portion and the second memory foam portion.

8. The bed of claim 7,
wherein the first compressible cell comprises a first inflated contour based at least on the first characteristic of the first contact area, and
wherein the second compressible cell comprises a second inflated contour based at least on the second characteristic of the second contact area.

9. The bed of claim 7,
wherein the first characteristic comprises a first body contour of the user in the first contact area, and
wherein the second characteristic comprises a second body contour of the user in the second contact area.

10. The bed of claim 7,
wherein the first characteristic comprises a first underlying body composition of the user in the first contact area, and
wherein the second characteristic comprises a second underlying body composition of the user in the second contact area.

11. The bed of claim 7, further comprising:
a third compressible cell disposed external to a body boundary of the user in the pre-determined posture and configured to:
inflate to a pre-determined height that is higher than the first compressible cell when inflated and the second compressible cell when inflated; and
prevent, in response to inflating to the pre-determined height, the user from rolling off the mattress.

12. A cushion for patient care to support a user in a pre-determined posture, comprising:
a first compressible cell configured to:
inflate based on a first characteristic of a first contact area of the user; and
contact, in response to inflating based on the first characteristic, the user in the first contact area on a top side of the first compressible cell;
a second compressible cell configured to:
inflate based on a second characteristic of a second contact area of the user; and
contact, in response to inflating based on the second characteristic, the user in the second contact area;
a first memory foam portion comprising:
a upper side in contact with a bottom side of the first compressible cell that is separate from the user, and
a lower side opposite the upper side;
a pressure control device configured to adjust air pressure of at least the first compressible cell;
a first pressure sensor configured to:
sense a first skin pressure in at least the first contact area; and
send a first signal to the pressure control device to facilitate adjusting, via the first air intake, a first air pressure of at least the first compressible cell based at least on the first skin pressure; and
a second pressure sensor configured to:
sense a second skin pressure in at least the second contact area; and
send a second signal to the pressure control device to facilitate adjusting, via the second air intake, a second air pressure of at least the second compressible cell based at least on the second skin pressure,
wherein the first air intake and the second air intake are separate and independent from each other,
wherein the first air pressure and the second air pressure are adjusted separately and independently from each other to allow the first contact area and the second contact area of the user to experience different skin pressures, and
wherein the first pressure sensor and the second pressure sensor are disposed on and in contact with the lower side of the first memory foam portion.

13. The cushion of claim 12,
wherein the first compressible cell comprises a first inflated contour based at least on the first characteristic of the first contact area, and
wherein the second compressible cell comprises a second inflated contour based at least on the second characteristic of the second contact area.

14. The cushion of claim 12,
wherein the first characteristic comprises a first body contour of the user in the first contact area, and
wherein the second characteristic comprises a second body contour of the user in the second contact area.

15. The cushion of claim 12,
wherein the first characteristic comprises a first underlying body composition of the user in the first contact area, and
wherein the second characteristic comprises a second underlying body composition of the user in the second contact area.

16. The cushion of claim 12, further comprising:
a second memory foam portion in cooperation with the first memory foam portion to support the first compressible cell and the second compressible cell against the user in the pre-determined posture,
wherein the first pressure sensor is disposed between the first memory foam portion and the second memory foam portion.

17. The cushion of claim 12, further comprising:

a third compressible cell disposed external to a body boundary of the user in the pre-determined posture and configured to:

inflate to a pre-determined height that is higher than the first compressible cell when inflated and the second compressible cell when inflated; and prevent, in response to inflating to the pre-determined height, the user from rolling off the mattress.

* * * * *